US006184788B1

(12) United States Patent
Middlemiss et al.

(10) Patent No.: US 6,184,788 B1
(45) Date of Patent: Feb. 6, 2001

(54) ELECTRONIC MISSING CARD ALERT CASE

(76) Inventors: Raymond Bradley Middlemiss, P.O. Box 954; Randolph Rodrique, P.O. Box 1617, both of Gibsons, British Columbia (CA), V0N 1V0

( * ) Notice: Under 35 U.S.C. 154(b), the term of this patent shall be extended for 0 days.

(21) Appl. No.: 09/453,496

(22) Filed: Dec. 3, 1999

(51) Int. Cl.[7] ..... G08B 13/14

(52) U.S. Cl. ..... 340/568.7; 340/568.1; 340/571; 340/522; 340/692; 340/570

(58) Field of Search ..... 340/568.7, 568.1, 340/571, 522, 692, 600, 570

(56) References Cited

U.S. PATENT DOCUMENTS

| | | | | |
|---|---|---|---|---|
| 4,631,527 | * | 12/1986 | De Witt et al. | 340/539 |
| 4,692,745 | * | 9/1987 | Simanowitz | 340/568 |
| 4,717,908 | | 1/1988 | Phillips et al. | 340/568 |
| 4,719,453 | * | 1/1988 | Beck et al. | 340/568 |
| 4,721,948 | * | 1/1988 | Lin | 340/568 |
| 5,052,328 | | 10/1991 | Eppenbach | 116/200 |
| 5,053,749 | * | 10/1991 | Weiss | 340/568 |
| 5,125,356 | | 6/1992 | Galante | 116/200 |
| 5,373,283 | * | 12/1994 | Maharshak | 340/568 |
| 5,418,520 | * | 5/1995 | Hirshberg | 340/568 |
| 5,790,027 | * | 8/1998 | Chern | 340/568 |
| 5,878,874 | | 3/1999 | Weggelaar | 206/39.1 |
| 5,884,764 | * | 3/1999 | Hartstone | 206/445 |
| 5,892,444 | * | 4/1999 | Wittmer et al. | 340/571 |
| 5,914,657 | * | 6/1999 | Chen | 340/568.7 |

* cited by examiner

*Primary Examiner*—Daniel J. Wu
*Assistant Examiner*—Tai T. Nguyen
(74) *Attorney, Agent, or Firm*—Qyen Wiggs Green & Mutala

(57) ABSTRACT

This invention relates to a novel electronic case for carrying credit cards and the like. More particularly, this invention pertains to a novel electronic case which accounts for the credit cards held in the case and sounds an alarm and activates an alert light if one or more of the cards is missing from the case. A portable electronic card carrying case comprising: (a) a case which can be opened to reveal the interior of the case, and closed to conceal the interior of the case; (b) at least one card receptacle housed in the interior of the case; (c) a power supply associated with the case; (d) a microprocessor associated with the case, the microprocessor being powered by the power supply; (e) an electronic sensor powered by the power supply and monitored by the microprocessor, and adapted to detect the presence or absence of a card in the card receptacle; and (f) an alarm which is activated when a card is not returned to its card receptacle, and the case is closed.

13 Claims, 6 Drawing Sheets

ELECTRONIC MISSING CARD ALERT CASE

TECHNICAL FIELD

This invention relates to a novel electronic case for carrying credit cards and the like. More particularly, this invention pertains to a novel electronic case which accounts for the credit cards held in the case and sounds an alarm and activates an alert light if one or more of the cards is missing from the case.

BACKGROUND

Credit cards are widely used in commerce as a method of payment for the purchase of a consumer product or conducting a transaction. A continuing problem with the use of credit cards, and the handling of them in making a purchase or conducting a transaction is that, not infrequently, the customer is in a hurry, or some distraction occurs, and the customer inadvertently fails to retrieve the credit card, or the credit card is not returned to the customer at the end of the transaction. This is a serious problem and merchants are continually faced with the problem of returning overlooked credit cards to their customers. The absence of the credit card for a time also provides an opportunity to an unscrupulous person to steal the card or copy it for unauthorized use. There is a strong need in the credit card industry for a system or mechanism which will eliminate or reduce the number of credit cards that are inadvertently lost or misplaced, even temporarily, by the person carrying the credit card.

U.S. Pat. No. 4,717,908, Phillips, et al., issued Jan. 5, 1998, discloses an alarm system that signals when one or more credit cards are absent from a card stack in the case if the system is enabled. In preferred form, a card stack thickness sensor responds to the stack thickness to determine whether all cards are present in the stack. A first signal device (e.g., a buzzer) in a circuit that includes a single sensor switch operated by the card stack thickness sensor informs the case's owner when not all cards are present if the circuit is enabled. A second signal device (e.g., one or more of the cards, or a separate flag) that is projectable from and retractable into the case's interior is operated by a circuit enabling switch, this switch being manually controlled for enabling the circuit when the case is to be stored (the second signal device being disabled, i.e., the indicator being retracted into the case, when the circuit is enabled) and for disabling the circuit when one or more cards is intentionally removed from the case for use (the second signal device then being enabled, i.e., the indicator being projected from the case, when the circuit is disabled). The second signal device alerts the case's owner that the circuit has been disabled if that is the fact that the circuit has been disabled in the event the owner tries to inadvertently return the case to a pocket in the owner's clothing or to the owner's purse without first enabling the circuit by retracting the second signal device into the case's interior.

U.S. Pat. No. 5,052,328, Eppenbach, issued Oct. 1, 1991, discloses a mechanical apparatus comprising a billfold including first and second sections and a hinge joining the sections for pivotal movement. The first section has a pocket with an opening which provides access to the pocket and the pocket is adapted to receive a card, such as a credit card, through the opening. The hinge joins the first and second sections for pivotal movement between a closed position in which the sections are in confronting, engaging relationship over major portions thereof and an open position in which the sections are out of confronting relationship and the opening of the pocket is exposed to allow insertion of the card into, and withdrawal of the card from, the pocket. A card-missing indicator is coupled to the billfold. The indicator is responsive to removal of the card from the pocket when the sections are in the open position for inhibiting pivotal movement of the first and second sections to the closed position.

U.S. Pat. No. 5,878,874, Weggelaar, issued Mar. 9, 1999, discloses a device for use in conjunction with a case or wallet. The device has compartments in which credit cards and the like are kept. The device has two parts which are movable relative to each other between a secure and open position. In the secure position, the cards and the device are retained for storage. In the open position, a card to be used may be removed from the device, but if the card is not replaced into the device, the device cannot return to the secure position. Therefore, should the user of the credit card not return the credit card to the device, it will be readily apparent to the user that the credit card is missing. The device has a locking lug which, depending on the locking lug's position in the device, the device may not be returned to the secure position unless the credit card used is returned to the device.

U.S. Pat. No. 5,125,356, Galante, issued Jun. 30, 1992, discloses a device for alerting an owner of a credit card, debit card, or the like, of a situation in which a card is missing from a card holder device. The device comprises a substantially planar sheet having a surface, a lower surface, an aligning edge, and at least two vacant edges and being configured for placement behind a card in a card holder device; and a substantially planar member positioned longitudinally along the aligning edge, the substantially planar member having a fixed edge affixed to the planar sheet and a free edge normally being biased in a direction away from the surface, the free edge being forced in a direction against the surface when pressure is applied toward the substantially planar member. The fixed edge may be affixed proximate the aligning edge or a vacant edge.

All of the above four prior art patents relate to designs for mechanisms within stacks, wallets or sleeves that inform the holder by various techniques when a card is absent or has not been replaced prior to closing the holder, case or wallet. None disclose a wallet that has an alarm that sounds and an alert light which illuminates when the wallet is closed with a card absent.

Weggelaar, U.S. Pat. No. 5,878,874, discloses a strictly mechanical system whereby a missing card releases a lock pin that prevents closing of the case or wallet. Galante, U.S. Pat. No. 5,125,356, also discloses a mechanical system whereby a missing card releases a visible raised or lifted flange or flap that indicates to the user of the case that a card is missing when the case or wallet is closed by the holder. Eppenbach, U.S. Pat. No. 5,052,328, also features a simple mechanical lever device. None of these patents have any bearing on the device of the subject invention.

Phillips et al., U.S. Pat. No. 4,717,908, is the only located patent that features electronic circuitry and an audible alarm in its device. This device is based upon the thickness of a "stack of cards". It features an audible device (i.e. a buzzer) and a visual device (i.e. card or flag protrudes from the wallet).

SUMMARY OF INVENTION

The invention is directed to a portable electronic card carrying wallet case comprising: (a) a case which can be opened to reveal the interior of the case, and closed to conceal the interior of the case; (b) at least one card receptacle housed in the interior of the case; (c) a power supply associated with the case; (d) a microprocessor associated with the case, the microprocessor being powered by the power supply; (e) an electronic sensor powered by the power supply and monitored by the microprocessor, and adapted to detect the presence or absence of a card in the card receptacle; and (f) an alarm which is activated by the microprocessor when a card is not returned to its card receptacle, and the case is closed.

The case can have at least six card receptacles, and each card receptacle can be equipped with an electronic sensor which can be electronically connected to the microprocessor and can detect the presence or absence of a card in the specific electronic card receptacle. The alarm can comprise a combination of a piezoelectric alarm and an LED illumination light.

The case can include a case sensor which is connected to the microprocessor and senses when the case is opened or closed. The case can include a holding catch which can hold the case in a closed position, and when moved, can enable the case to be opened to reveal the card receptacle. The case can include an electronic timer connected to the microprocessor, the timer determining according to a program the length of time that the alarm is sounded.

The case can be comprised of two sections, which can be hinged together, the two sections being moved apart to reveal the interior of the case, and moved together to close the case. The case can be comprised of a base section and a top section, which top section can be hinged to the base section, the top section when moved away from the base section, revealing the contents of the case, and when moved to the base section, closing the case. The case can include a pop-up mechanism which can lift the card receptacle from the base section of the case when manually activated by a pop-up button.

The microprocessor can be programmed to instruct the alarm to emit a favourable sound when the case is closed and a card is present in the case card receptacle.

The case can include an electronic low voltage detector which can detect when the available power in the power supply has reached a predetermined minimum level. The case can include at least six card receptacles arranged in series, and a corresponding number of electronic sensors which detect the presence or absence of cards in each of the six specific card receptacles, and when the sensor of a specific card receptacle senses a card is missing from the receptacle, and the case is closed, the sensor can communicate with the microprocessor to activate the alarm and the LED indicating a missing credit card.

The microprocessor can be associated with an electronic circuit which, when the case is closed, can function in a minimum electricity drain mode, and when the case is opened, can function in an operating electricity drain mode. The circuit, when in an operating mode, can scan the sensors and detect a card missing from the receptacle and when the card is returned to the receptacle and the case is closed, the circuit can scan the sensors, and if all cards are present, can cause the alarm to sound twice and the LED to illuminate twice in succession.

The card can be a credit card and the microprocessor can be programmed to account for the length of time the card is absent from the receptacle and if the time is exceeded, can cause the alarm to sound.

BRIEF DESCRIPTION OF DRAWINGS

In drawings which illustrate specific embodiments of the invention, but which should not be construed as restricting the spirit or scope of the invention in any way.

DETAILED DESCRIPTION OF SPECIFIC EMBODIMENTS OF THE INVENTION

Figure 1:
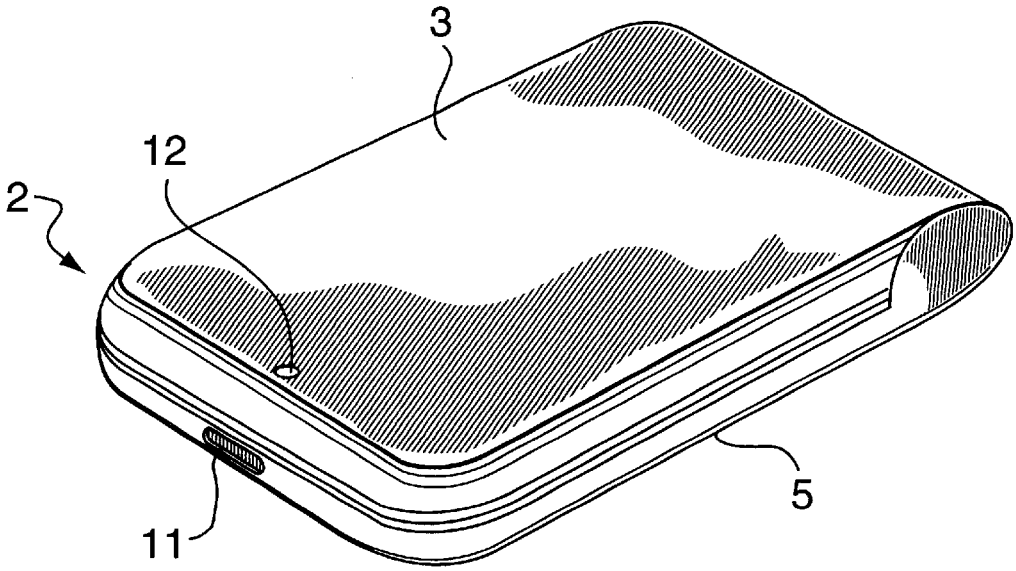
FIG. 1 illustrates an isometric view of a first embodiment of the electronic wallet case in closed position.

Referring to the drawings, FIG. 1 illustrates an isometric view of a first embodiment of the electronic wallet case 2 in an closed position. As seen in FIG. 1, the electronic wallet case 2 is constructed of a case top 3 and a case bottom 5, hinged in clam-shell manner at one end, with an LED indicator 12 and an alarm 11 located at the opposite end.

Figure 2:
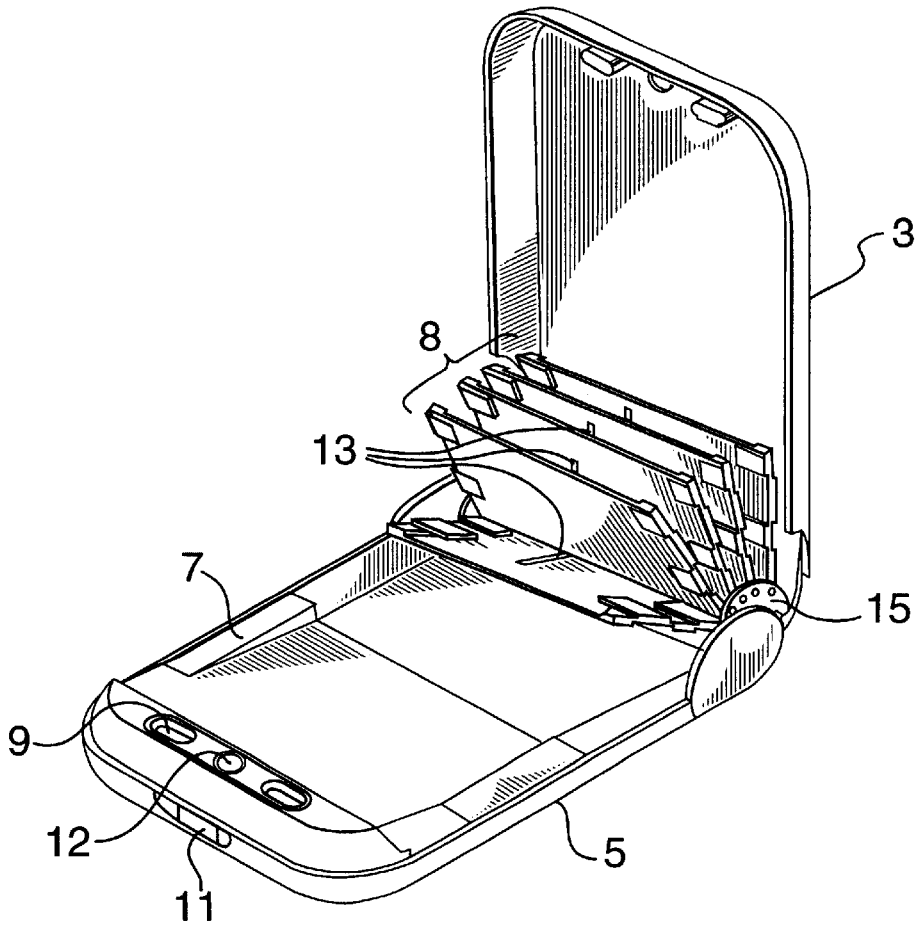
FIG. 2 illustrates an isometric view of a first embodiment of the electronic wallet case in open position.

FIG. 2 illustrates an isometric view of the first embodiment of the electronic wallet case 2 in an open position and displaying a fanned array of card pockets 8. Each card pocket is equipped with a pocket sensor 13. The bottom case 5 also is equipped with a case sensor 9 which senses when the case top 3 and case bottom 5 are closed together (see FIG. 1) or in open position, as shown in FIG. 2. The card pockets 8 are hinged together about hinge 15. The case bottom 5 has a raised circuitry protection area 7 at one side. FIG. 2 also illustrates the LED indicator 12 and the acoustic alarm 11.

Figure 3:
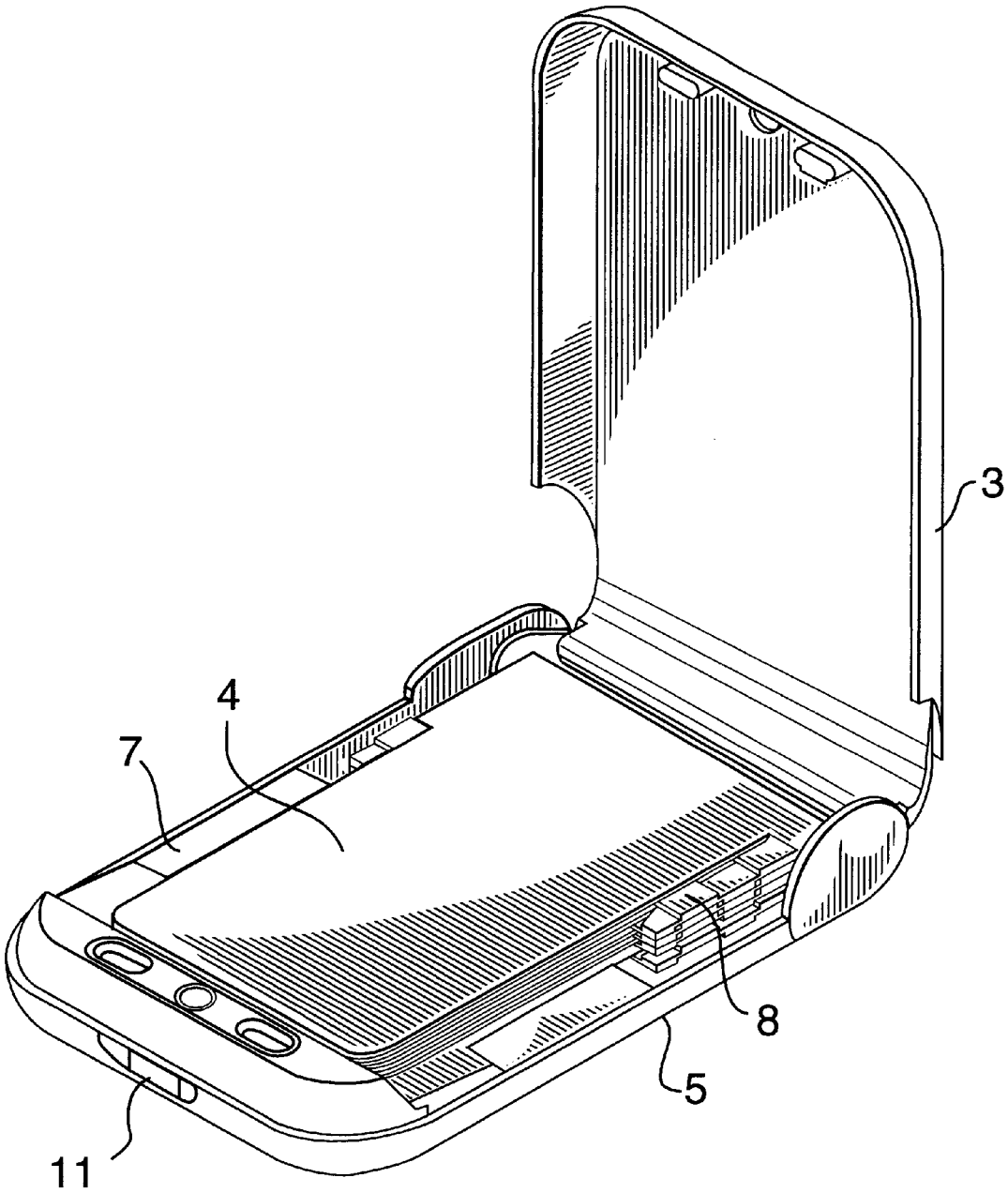
FIG. 3 illustrates an isometric view of the first embodiment of the electronic wallet case in open position with credit cards stacked on the case bottom.

FIG. 3 illustrates an isometric view of the case top 3 and case bottom 5 in open position with credit cards 4 fitted in each card pocket 8 and arrayed in stacked position on the case bottom 5.

The electronic credit card carrying wallet case 2 according to the invention is a hard case container constructed of injection molded plastic. It is custom fitted with a concealed electronic printed circuit board 48 (see FIG. 6). The printed circuit board is designed to trigger an electronic acoustic alarm 11 as well as illuminate a LED 12 indicator when an absent credit card 4 is detected. The electronic wallet reacts only when a card 4 (see FIG. 3) has been removed from its assigned card pocket 8 and the case 2 is closed. In such a situation, the acoustic alert 11 will remain active for up to three seconds after the case has been closed. However, the LED 12 display remains active until the missing card 4 has been placed back into its assigned pocket 8.

The hard case can optionally have a cloth or membrane cover for ornamentation. The electronic printed circuit board is located and isolated under the circuitry protection housing 7 shown in FIG. 2. This protects the circuit board from damage. The power source for the electronic system is mounted on the circuit board. The electronic wallet case 2 is sized so that it readily fits in the palm of a person's hand and is easily opened and closed. Typically, the physical dimensions of the wallet 2 are 4 inches long, 2½ inches wide and ½ inch thick. Each card 4 carried in the electronic wallet 2 has a designated electronic circuited pocket 8 with individual pocket sensors 13. When the card 4 is in the pocket 8, the sensor 13 is activated and the electronic acoustic alert 11 and visual LED 12 are not activated. Furthermore, when the electronic wallet is first opened and a card 4 is removed, the acoustic alert and the LED 12 are not activated. However, if the card 4 is not returned to its assigned pocket 8 and the case 2 is closed, as sensed by case sensor 9, the internal electronic acoustic alarm 11 sounds and the LED 12 display illuminates. Specifically, the red LED 12 visual warning light is activated when the case 2 is closed and the internal case pocket 8 with contacts are closed. This happens when a card 4 has not been placed back into its pocket 8, as detected by the respective pocket sensor 13.

Figure 4:
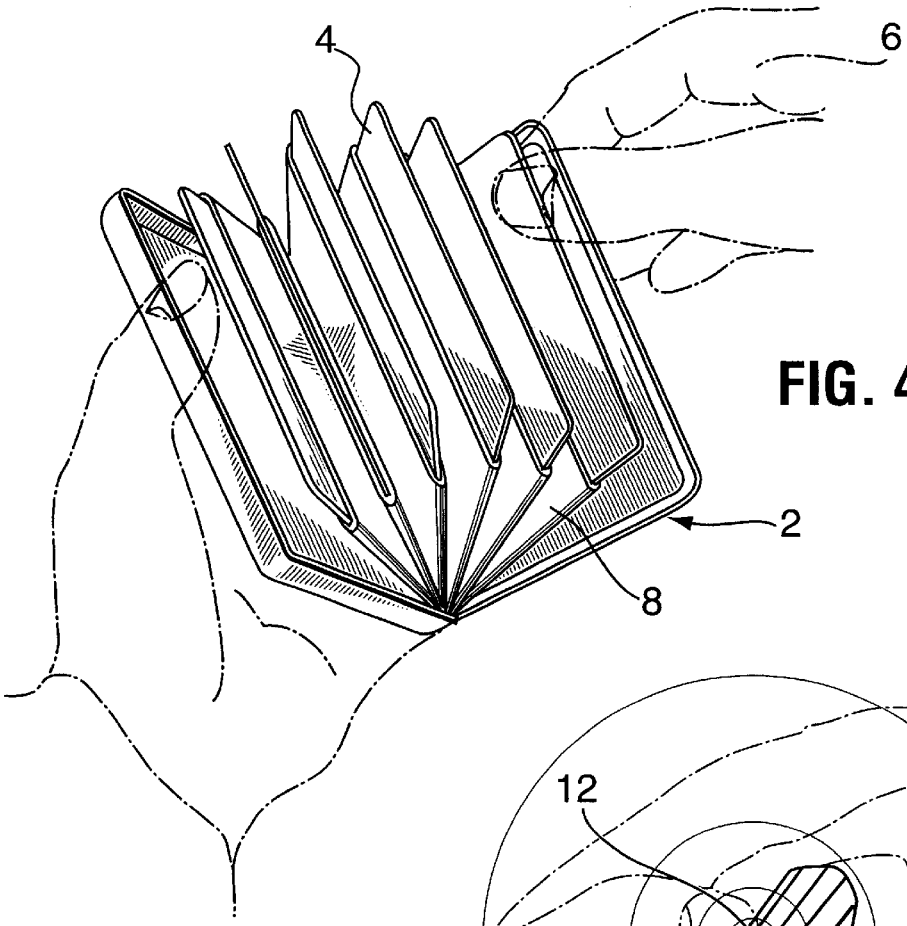
FIG. 4 illustrates an isometric view of a second embodiment of the electronic wallet case in an opened position to display credit cards held in an array of card holders.

FIG. 4 illustrates an isometric view of a second embodiment of the electronic wallet case 2 in an open position to display an array of credit cards 4. As seen in FIG. 4, the left hand of the user is holding the electronic wallet case 2 in the open position while the right hand 6 of the user is extracting a credit card 4. As seen in FIG. 4, the electronic wallet case 2 has six credit card pockets 8 arranged in parallel side by side manner.

Figure 5:
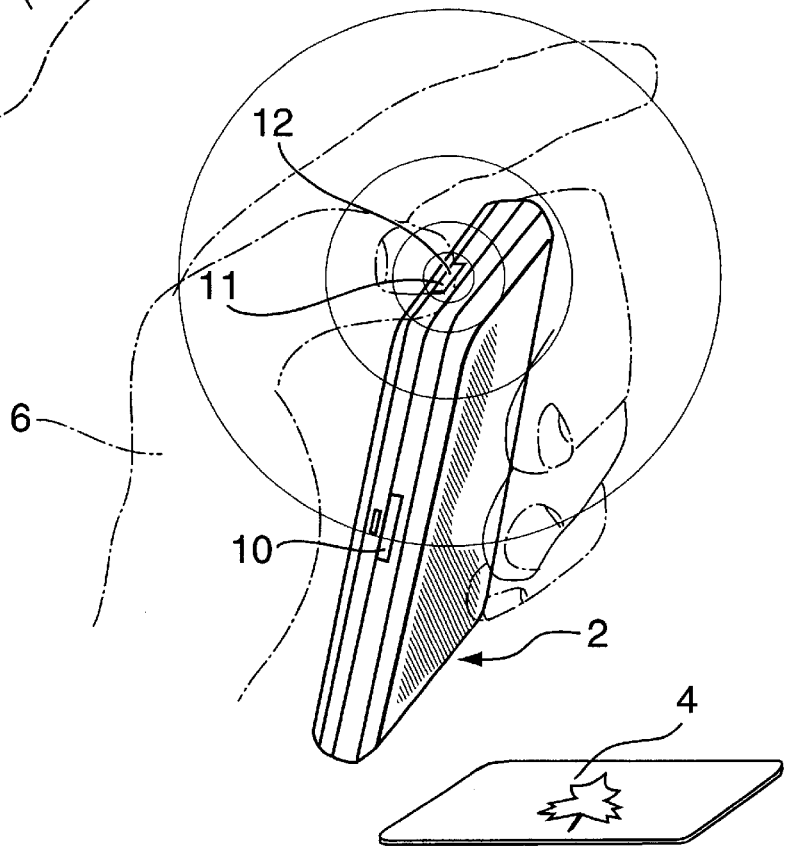
FIG. 5 illustrates an isometric view of the second embodiment of the electronic wallet case in a closed position and displaying an activated LED, indicating an absent credit card.

FIG. 5 illustrates an isometric view of the second embodiment of the electronic wallet case 2 in a closed position and displaying an activated alarm 11 and LED 12. In the situation illustrated in FIG. 5, the missing credit card 4 is laying on a counter, and the electronic wallet case 2 has been closed and a catch 10 engaged. Since the credit card 4 is missing from its designated pocket 8, and the case 2 has been closed, the LED 12 illuminates and the acoustic alarm 11 sounds, as indicated pictorially by the concentric circles shown in FIG. 5.

Figure 6:
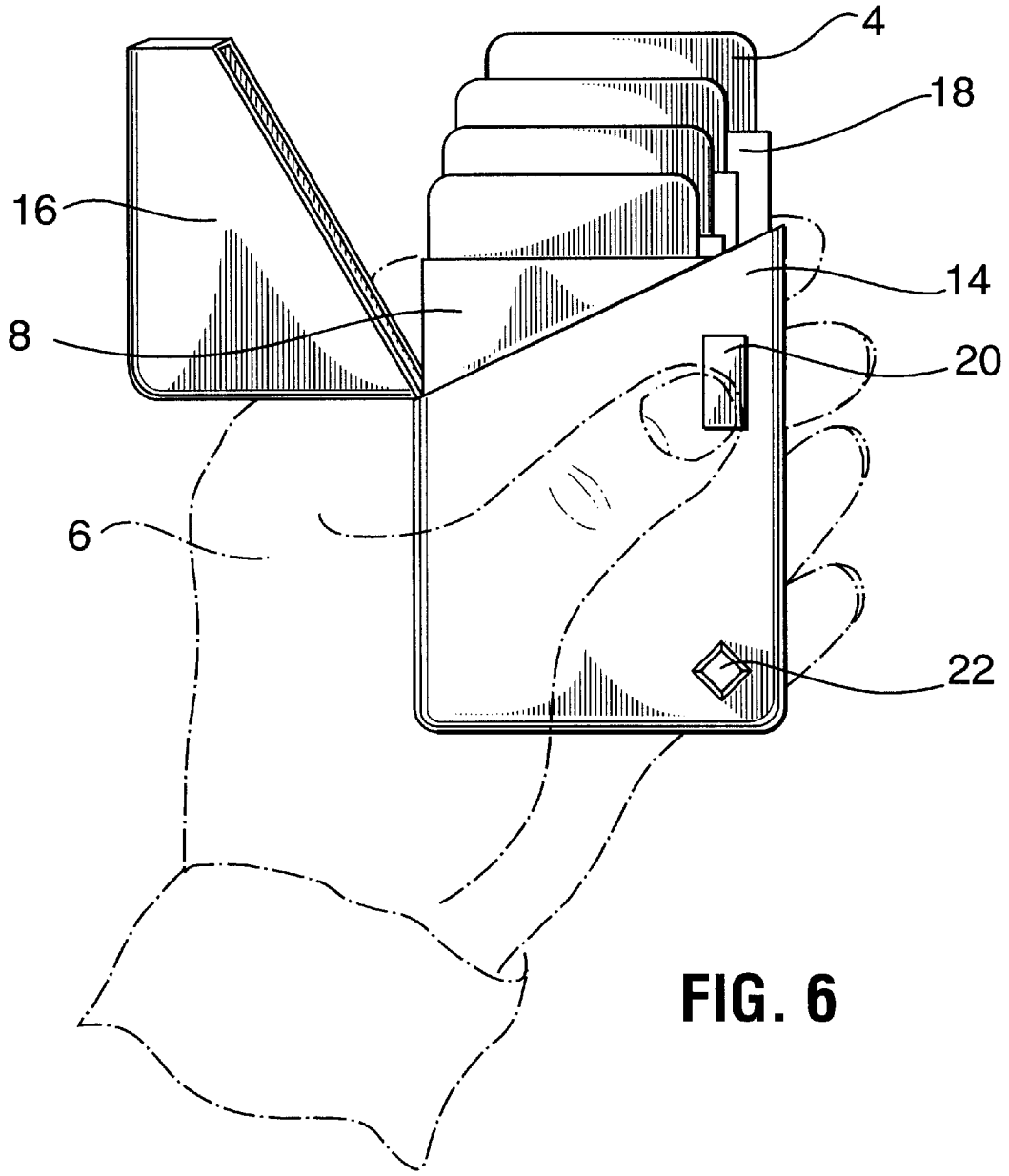
FIG. 6 illustrates an isometric view of a third embodiment of the electronic wallet case with a flip top and a credit card raising card holder.

FIG. 6 illustrates an isometric view of a third embodiment of the electronic wallet case 14 with a flip top 16 and a card raising feature 18. The cards 4 are raised in the card pop-up 18 by moving a pop-up button 20 using the thumb of the user's hand 6. The LED 22 is also illustrated in FIG. 6. In all other respects, the third embodiment of electronic wallet case 14 operates in the same manner as the first and second embodiment of the electronic wallet 2, as illustrated previously in FIGS. 1 through 5. If a credit card 4 is missing from its designated pocket 8, and the flip top 16 is closed, the electronic circuitry of the flip top electronic wallet case 14 and the pockets 8 operate to detect the missing card 4 and as a consequence the LED 22 is illuminated and a piezoelectric alarm (not shown) is activated.

Figure 7:
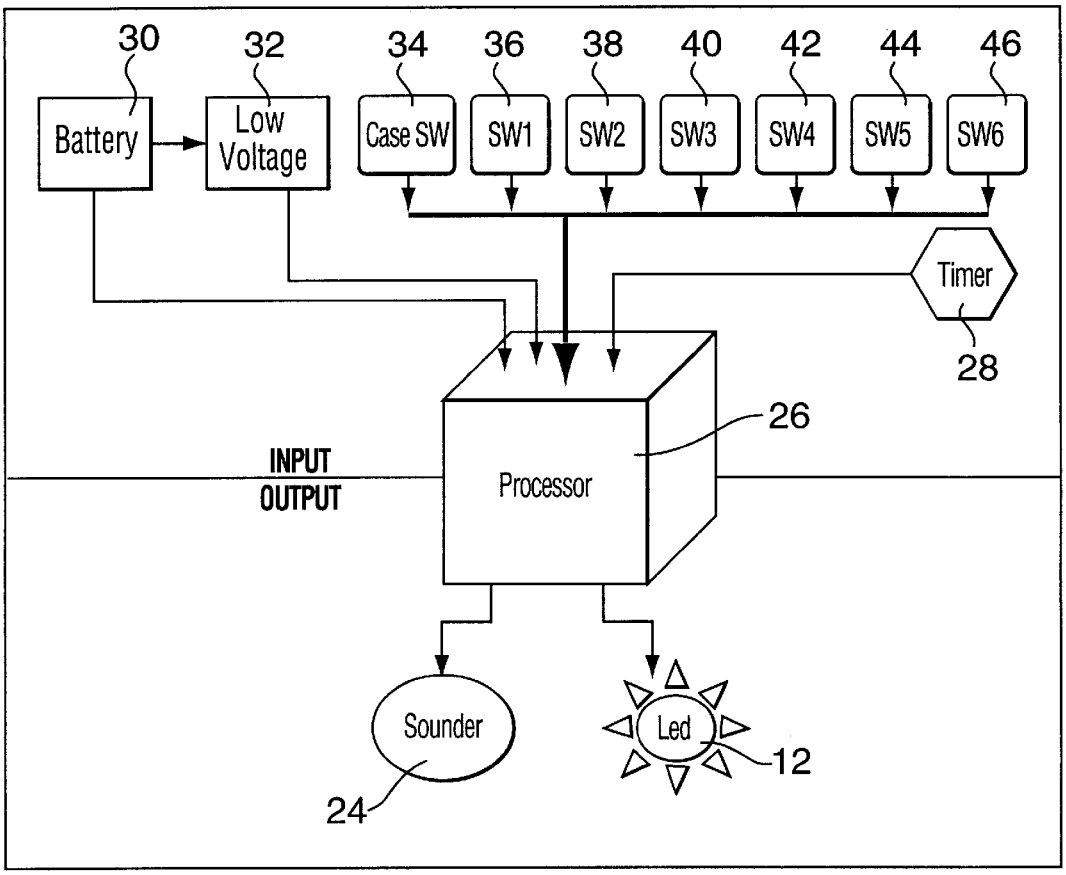
FIG. 7 illustrates a schematic of the electronic input/output components of the electronic wallet case.

FIG. 7 is a schematic of the electronic input/output components of the electronic wallet case 2. As shown in FIG. 7, the input/output components comprise an LED 12, an acoustic piezoelectric alarm 24 (identified as item 11 in FIGS. 1 and 2), which are electronically connected to a programmed microprocessor 26. An electronic timer 28 is also electronically connected to the microprocessor 26. A power supply (battery) 30, connected to a low voltage detector 32, is connected to the programmed microprocessor 26 and provides electric power to the microprocessor 26 in order to drive the system. An array of switch sensors including a case sensor (case SW) 34, and six sensors (SW1–SW6) designated by reference numerals 34, 36, 38, 40, 42, 44 and 46, which correspond to card pockets 8 of the electronic wallet 2, are connected to the microprocessor 26.

Figure 8:
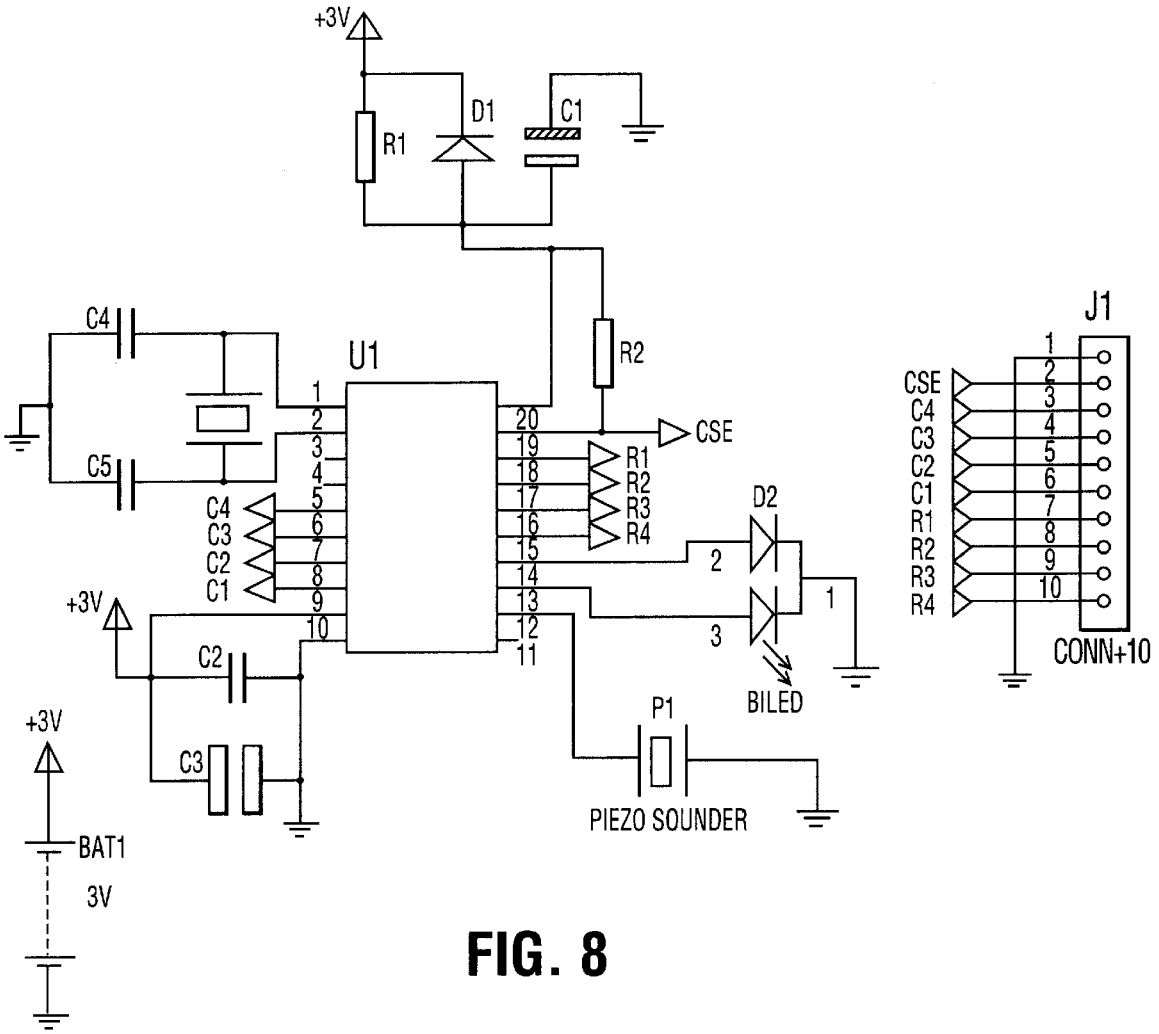
FIG. 8 illustrates a depiction of the circuitry layout of the electronic wallet case.

FIG. 8 illustrates the circuitry layout for the electronic wallet case 2. The electronic components illustrated are shown in accepted electric circuit depictions understood by a person skilled in electronic circuitry, including microprocessor U1, capacitors C1 to C4, battery BAT 1 and piezo alarm P1.

Figure 9:
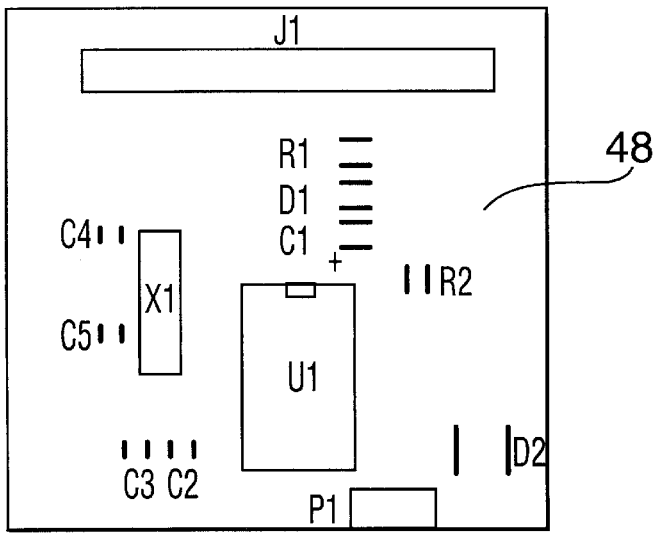
FIG. 9 illustrates a depiction of the circuit board layout of the electronic wallet case.

FIG. 9 represents a depiction of the chip circuit board layout of the electronic wallet case 2 and shows the positions of the various components on the circuit board 48. It will be understood that the respective positions on the circuit board 48 can be altered without affecting the spirit and scope of the invention.

General Description of of Electronic Wallet Prototype

The electronic wallet case 2 is currently designed to carry six cards 4 (credit cards, ATM cards, driver's licences, etc.) in six pockets 8. However, the chip circuitry 48 can support up to and including sixteen discrete pockets.

The "intelligence" features of the wallet case 2 are programmed into the microprocessor 26 and through the use of the circuitry described herein, cause the wallet case 2 to be able to alert the user to the absence of a card 4 (due to loss, failure to retrieve, etc.) upon closure of the case 2, or even in certain circumstances, when programmed as an option, alert the user to an "overdue" card 4 before closure of the wallet 2. Once all of the cards 4 have been inserted into their pockets 8, the microprocessor can be programmed to cause the case 2 to emit a "happy" tone upon closure.

In addition to the acoustic alarm sounder 24 and the several different "tones" that the sounder can produce for various different conditions, the wallet case 2 is equipped with a LED (light emitting diode) 12 for visual indication of a fault or alarm condition.

Description of Input/Output Schematic

As a basic approach to designing the schematic design illustrated in FIG. 4, the following points were taken into consideration:

Inputs (1) The case switch 34 (which may be located in the latching mechanism—see case sensor 9 in FIG. 2 or catch 10 in FIG. 5—or in the hinge 15), is used to indicate CLOSED/OPEN conditions of the wallet 2.

(2) Six card switches 34 to 46 (one located within each card pocket 8), have been used to sense the presence/absence of individual cards 4.

(3) A 20 minute timer 28 (implemented in either firmware or hardware), has been used to time "overdue" card conditions.

(4) A low battery voltage circuit 32 has been used to indicate a LOW/REPLACE battery condition (optional).

(5) A power supply 30 of the lithium small "button" or "coin" type has been used because of its long life and high energy density with the primary cell generating 3.0 VDC.

Outputs (1) A low voltage light emitting diode (LED) (12 or 22 in FIGS. 1 through 5) has been used to provide a visual indication of an alarm/fault condition.

(2) A low voltage piezo sounder 24 has been used to provide audio indication of alarm/fault condition.

Description of Operation of Electronic Wallet

During normal operation, when the case 2 is not open, the circuit will be in a "low power" mode. In the low power mode, the circuit consumes a minimum of current, thereby extending the life of the battery 30.

When the case 2 is opened by releasing catch 10, the circuit will "boot up" to full operation. Upon opening the case 2, a tone will sound and the LED will flash (green) for approximately one second. This is to acknowledge that the case 2 is open and that the circuit is operating correctly.

Within 500 mS (milliseconds) of the end of the (case open) tone, the circuit (see FIG. 5) will start to scan the switch matrix. The switch matrix consists of a four column by four row (for a total capacity of 16 switches) matrix. The matrix is scanned in a column by row sequence, a logic high signal would be placed on the common terminal of all four switches in one column. Then the normally closed terminals of each switch will be individually sampled. If a card in that column has been removed, the corresponding switch will return a logic high signal. While the scan operation is in process, a bit position counter is being executed within the processor. If the scan process encounters a logic high signal (a missing card 4) the appropriate bit in the bit position register is set. The result of this process (once the entire matrix has been scanned) is a "card map" that can indicate exactly which card(s) 4 is (are) missing. This scanning will continue until a card 4 is removed or the case 2 is closed.

When a card 4 is removed, a "card removed" tone is sounded. (This sound is different from any other tone). At the same time, a firmware timer 2 is started and the switch matrix is continuously scanned. If the card(s) is (are) not returned to the case 2 before the timer 28 ends (approximately 20 minutes), then a "card overdue" tone is sounded and the L.E.D. 12 or 22 will flash (red). After the "overdue tone" has sounded, a second timer is started. This timer is a 5 minute rollover timer. If the second (rollover) timer expires and the card 4 is not returned, the "overdue tone" will sound again and the rollover timer will be reset. This process will continue until the card 4 is returned or the case is closed.

When the card 4 is returned, the "card tone" will sound and the switch matrix will be scanned once again. If all of the cards 4 are present, the timers will be stopped. If there are still absent cards, the "overdue" timer sequence will reset and be restarted.

When the case 2 is closed, the switch matrix is scanned again, if there are any cards missing, the "card missing" (sad) tones will sound and the LED 12 or 22 will flash (red) at approximately one flash per second. The LED will continue to flash and the "card missing" tones will be repeated at regular intervals until the missing card(s) is (are) returned.

If (when the case is closed) all of the cards are present, a "cards secure" (happy) tone will sound and the LED will flash twice (green). The circuit will then drop into low power mode and await the next case opening event.

Overall Circuitry Description

TABLE 1

List of Components for Electronic Wallet Case Prototype

| Qty. | Ident. | Value | Part No. | Supplier | Cost/ea. LRP | Ext. |
|---|---|---|---|---|---|---|
| 1 | R1 | 100K | CR1206-1003JTR-BKN | Future Shop | 0.042 | 0.042 |
| 1 | R2 | 4K7 | CR1206-47013TR-BKN | Future Shop | 0.042 | 0.042 |
| 1 | C1 | 1uF/16V | 105K16AS | Future Shop | 0.65 | 0.65 |
| 1 | C2 | 0.1uF | 08055E104MATMS | Future Shop | 0.13 | 0.13 |
| 1 | C3 | 0.1uF/16V | 104K35A5 | Future Shop | 0.65 | 0.65 |
| 2 | C4, C5 | 27pF | 08055A270JATRS | Future Shop | 0.22 | 0.44 |
| 1 | U1 | MC68HC705J1A | MC68HC705J1ACDW | Future Shop | 6.7 | 6.7 |
| 1 | D1 | 1N4148 | MLL4148T | Future Shop | 0.1 | 0.1 |
| 1 | D2 | Biled | ZURMG57W | Macom Agencies | 0.15 | 0.15 |
| 1 | BAT1 | 3V | 3002 | Electro Sonic | 0.433 | 0.433 |
| 1 | P1 | Piezo Sounder | SMT-2114 | Future Shop | 4.3 | 4.3 |
| 1 | X1 | 2.0MHZ | CSAC200MGCA | Future Shop | 1.6 | 1.6 |

As shown in the schematic drawing (FIG. 8), the circuit has been designed to use as few parts as possible (in order to keep production costs low). The circuit consists of a processor (U1), some support circuitry (C1 to C5, R1, D1 and X1), input (J1) and output (P1, D2).

The processor is a Motorola MC68HC705J1A part. This processor is part of a family of specialized low power devices based upon the 6805 processor core. This processor was selected for its advanced peripheral devices which allowed for most of the simplicity of the circuit.

The oscillator circuit, comprised of C4, C5 and X1, supplies the clock signal for the processor (U1). The device chosen is of the peizo oscillator type, and was chosen for its lower cost (compared to a conventional crystal).

The power decoupling circuit, comprised of C2 and C3, filters and decouples the processor's voltage supply. This helps with the overall stability of the circuit.

The "power up reset" circuit, comprised of R1, D1 and C1, holds the processor (U1) in the reset state during power up until a stable voltage level has been reached.

The interrupt pull up resistor (R2) ensures that a logic high (3 V) level is maintained on the processor's interrupt pin. This pin is used to "wake up" the processor when the case is opened by pulling the pin to a logic low (0 V-ground) level.

The switch matrix connector (J1) provides a connection point for the switch matrix. The switches are connected to the connector in the following manner:

The common terminal of switch 1 would connect to column 1 (pin 6, J1). The normally closed terminal of switch 1 would connect to row 1 (pin 7, J1).

The common terminal of switch 2 would connect to column 1 (pin 6, J1). The normally closed terminal of switch 2 would connect to row 2 (pin 8, J1).

The common terminal of switch 3 would connect to column 1 (pin 6, J1). The normally closed terminal of switch 3 would connect to row 3 (pin 9, J1).

The common terminal of switch 4 would connect to column 1 (pin 6, J1). The normally closed terminal of switch 4 would connect to row 2 (pin 10, J1).

The column 2 switches would be connected in a similar manner except that instead of connecting the common terminals to column 1, they would be connected to column 2 (pin 5, J1). The normally closed terminals would be connected as the column 1 switches were (row 1, row 2, etc.). This process would be repeated for columns 3 and 4, giving a total of 16 switches. If the application requires less than 16 switches, the remainder are left unconnected and will be read by the processor as a pocket with a card present.

The bicolour LED (D2) 12 or 22 is used to indicate the overall status of the product. By energizing one of the contacts, the device will emit green light. By energizing the other contact, the device will emit red light. If both contacts are energized at the same time, the device will emit yellow light.

The peizo sounder (P1) 24 is used to provide audio indication of product status. Since the peizo sounder 24 used has no internal drive circuitry, the processor (U1) 26 has to provide a pulsed signal to drive the sounder. The rate (frequency) at which the signal from the processor pulses determines the tone emitted by the sounder. This allows the processor 26 to produce a wide range of tones to indicate different conditions.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A portable electronic card carrying case comprising:

(a) a hollow case which can be opened to reveal the interior of the case, and closed to conceal the interior of the case, wherein the case is comprised of a base section and a top section, which top section is hinged to the base section, the top section when moved away from the base section, revealing the contents of the case, and when moved to the base section, closing the case and concealing the contents of the case;

(b) at least one card receptacle housed in the interior of the case;

(c) a pop-up mechanism which, when activated, lifts the card receptacle from the base section of the case;

(d) a power supply associated with the case;

(e) a microprocessor associated with the case, the microprocessor being powered by the power supply;

(f) an electronic sensor powered by the power supply and monitored by the microprocessor, for detecting the presence or absence of a card in the card receptacle; and (g) an alarm which is activated by the microprocessor when a card is absent from its card receptacle, and the case is closed.

2. A case as claimed in claim 1 wherein the case has at least six card receptacles in its interior, and each card receptacle is equipped with an electronic sensor which is electronically connected to the microprocessor and detects the presence or absence of a card in the specific electronic card receptacle.

3. An case as claimed in claim 1 wherein the alarm comprises a piezoelectric alarm and an LED illumination light.

4. A case as claimed in claim 3 including at least six card receptacles arranged in series, and a corresponding number of electronic sensors which detect the presence or absence of cards in each of the six specific card receptacles, and when the sensor of a specific card receptacle senses a card is missing from the receptacle, and the case is closed, the sensor communicates with the microprocessor to activate the alarm and the LED indicating a missing credit card.

5. A case as claimed in claim 4 wherein the microprocessor is associated with an electronic circuit which, when the case is closed, functions in a minimum electricity drain mode, and when the case is opened, functions in an operating electricity drain mode.

6. A case as claimed in claim 5 wherein the circuit, when in an operating mode, scans the sensors and detects a card missing from the receptacle and when the card is returned to the receptacle and the case is closed, the circuit scans the sensors, and if all cards are present, causes the alarm to sound twice and the LED to illuminate twice in succession.

7. A case as claimed in claim 1 including a case sensor associated with the microprocessor, said case sensor detecting when the case is opened or closed.

8. A case as claimed in claim 1 including a holding catch which holds the case in a closed position, and when moved, enables the case to be opened to reveal the card receptacle.

9. A case as claimed in claim 1 including an electronic timer connected to the microprocessor, said timer determining according to a program the length of time that the alarm is sounded.

10. A case as claimed in claim 1 wherein the pop-up mechanism lifts the card receptacle from the base section of the case when manually activated by a pop-up button.

11. A case as claimed in claim 1 wherein the microprocessor is programmed to instruct the alarm to emit a favourable sound when the case is closed and a card is present in the case card receptacle.

12. A case as claimed in claim 1 including an electronic low voltage detector which detects when the available power in the power supply has reached a predetermined minimum level.

13. A case as claimed in claim 1 wherein the card is a credit card and the microprocessor is programmed to account for the length of time the card is absent from the receptacle and if the time is exceeded, causes the alarm to sound.

* * * * *